US006646369B2

(12) United States Patent
Van der Wilk

(10) Patent No.: US 6,646,369 B2
(45) Date of Patent: Nov. 11, 2003

(54) DISPLAY TUBE COMPRISING A MASK WITH VIBRATION DAMPING MEANS

(75) Inventor: Ronald Van der Wilk, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 79 days.

(21) Appl. No.: 09/908,595

(22) Filed: Jul. 19, 2001

(65) Prior Publication Data

US 2002/0021072 A1 Feb. 21, 2002

(30) Foreign Application Priority Data

Jul. 25, 2000 (EP) ..... 00202674

(51) Int. Cl.[7] ..... H01J 29/80
(52) U.S. Cl. ..... 313/402; 313/404; 313/407
(58) Field of Search ..... 313/402, 404, 313/407

(56) References Cited

U.S. PATENT DOCUMENTS 4,827,179 A * 5/1989 Adler et al. ..... 313/402
6,469,429 B1 * 10/2002 Berton ..... 313/402
6,469,431 B1 * 10/2002 Suzuki et al. ..... 313/407

FOREIGN PATENT DOCUMENTS

| | | | |
|---|---|---|---|
| EP | 0984482 A2 | 8/1999 | ..... H01J/29/07 |
| EP | 1087418 A1 | 9/2000 | ..... H01J/29/07 |

* cited by examiner

*Primary Examiner*—Sandra O'Shea
*Assistant Examiner*—Peter Macchiarolo

(57) ABSTRACT

A cathode ray tube comprising a color selection electrode supported in tension. The electrode includes a circumferential portion on which vibration damping means are located for damping vibrations in the color selection electrode. The vibration damping means include a resonator in the form of at least one metal tongue, which is capable of vibrating when the color selection electrode vibrates. The tongue is arranged in, or substantially parallel to, the plane of the color selection electrode. Means are provided to exchange vibration by means of collision and/or friction between the circumferential portion of the color selection electrode and the tongue.

17 Claims, 3 Drawing Sheets

DISPLAY TUBE COMPRISING A MASK WITH VIBRATION DAMPING MEANS

The invention relates to a display tube comprising a display window having two short sides and two long sides, and a color selection electrode having a longitudinal axis and a transverse axis and supporting means for supporting the color selection electrode in tension, which color selection electrode comprises a central portion having apertures allowing passage of electrons, and a circumferential part, which circumferential part is provided with vibration damping means.

A color display tube comprising a color selection electrode customarily includes a display screen having a pattern of lines or dots of an electroluminescent material, and an electron gun for generating electron beams, the color selection electrode, which may comprise a mask of the wire-mask or shadow-mask type, being arranged between the electron gun and the display screen. The mask is formed by, for example, a thin metal foil having a large number of apertures, which must be very accurately arranged so as to be very close to the display screen, so that the mask apertures are systematically aligned with respect to the luminescent lines or dots of the display screen. To maintain this systematic alignment, the mask must be suitably suspended in the color display tube, in order to make sure that the mask remains in an accurately determined position during the manufacture of the tube as well as during operation of the tube. To achieve this, a frame is used as a supporting device, which frame carries the mask and is suspended in the tube. The frame is generally rectangular comprising two short sides and two long sides, a transverse axis parallel to the short side, and a longitudinal axis parallel to the long side.

In the case of a mask with a single curvature (for example a cylindrical curvature), a frequently used construction comprises a rigid, heavy frame provided with the proper curvature, after which the mask is clamped to the curved sides. Also in the case of a flat mask, an example of a frequently used construction is that wherein the tension mask is supported by a frame.

Examples of such tension masks are the masks used in the Sony Trinitron™ tube and the Zenith FTM™ (flat tension mask) tube. The FTM tube employs a so-called dot screen, wherein the phosphor elements are provided in the form of triads of red, blue and green dots, which requires aligning by, and application of, mechanical tension in both the longitudinal and the transverse direction of the mask.

The Sony tube employs a so-called striped screen, wherein the phosphor elements are arranged in the form of juxtaposed triads of red, blue and green stripes, as a result of which aligning is necessary only in the direction transverse to the stripes. The Sony mask is a grid structure of grid elements clamped to a rectangular frame so as to extend parallel to the transverse axis. The grid elements are clamped between the supports of the frame in such a manner that even heating and expansion does not cause them to become slack.

Display tubes currently being developed, in particular (flat) display tubes of the striped-screen type employ so-called slotted masks, wherein a number of comparatively long slots are situated below each other in the longitudinal direction.

In all of the above cases, the mask is a very thin, not self-supporting foil, which is supported by the frame while being subjected to a fairly high tension.

Both the cylindrical and the flat masks of this type can easily be set vibrating, which may be caused, for example, by external shocks or by a loudspeaker situated in the vicinity of the display tube. The resonant frequency of the mask vibrations depends on the mechanical parameters and the tension in the mask. Each vibration of the mask will result in electron beams not impinging on the associated phosphor elements, which leads to color impurities in the image displayed.

Various means for damping said vibrations have been proposed.

In the case of cylindrically curved tension masks, for example, a damping wire is clamped across the grid elements of the mask in a direction parallel to the longitudinal axis. In such an arrangement, the damping wire exerts a spring pressure on the grid elements, so that they are less easily set vibrating by external, mechanical shocks. This solution can be applied to (cylindrically) curved masks, but not to flat tension masks.

In Patent Abstracts of Japan, publication number 11054061, a (flat) mask is described which is clamped in two directions. The vibration damping means comprise a number of movable, cylindrical parts arranged along the four circumferential sides and fixed parts of wire material which extend through the movable parts and are secured to the mask so as to be under tension in order to press the movable parts against the mask. This arrangement is voluminous, its manufacture is rather complicated, and adjusting it so as to suppress a specific, disturbing vibration frequency is difficult.

It is an object of the invention to provide a damping-means arrangement which can suitably be applied to both flat and curved masks, which takes up little space, is easy to make and, preferably, also easy to adjust.

To achieve this, a display tube of the type described in the opening paragraph is characterized in that the vibration damping means include a resonator in the form of at least one metal tongue, which is capable of vibrating when the color selection electrode vibrates, and is arranged in such a way, and/or co-operates with such means, that it is capable of exchanging vibration energy by means of collision and/or friction with the circumferential part of the color selection electrode.

The use of one or more tongues as vibration damping means, which, for example, can be formed from the mask itself (for example by etching) or which can be welded onto the mask has various advantages.

These tongues are easy to make (in particular if they are etched from the mask) and can be readily provided. By suitably choosing their dimensions (in particular the length dimension) and their mass, they can be adjusted to a desired resonant frequency. If the tongues extend in, or parallel to, the plane of the mask, they take up little space. By making them collide with or rub against the mask, they can exchange vibration energy without additional parts being required, as in the arrangement described in, for example, U.S. Pat. No. 4,827,179, which arrangement includes flexible lugs, which extend transversely to the plane of the mask and are welded onto a bracket, and "friction brakes" connected with said lugs. Without such "friction brakes", the vibration is not effectively damped.

It will be clear that the arrangement in accordance with the invention can be applied to curved as well as flat tension masks. To function properly, it is important that the color selection electrode comprises parts which are mechanically connected to one another and extend parallel to the transverse axis. Particularly dot masks and slotted masks meet this requirement.

Preferably, one or more tongues are provided on the mask near one, or both, short sides of the display window because at said location the operation of said tongue(s) is most effective.

In a simple embodiment which takes up little space, the tongue, or tongues, are formed from the material of the circumferential part of the mask (for example by means of etching) and have four sides, three of which are separated from the material of the circumferential part by slots. Such a tongue is situated in, or extends parallel to, the plane of the mask and is capable of vibrating in the opening formed during the formation of the tongue. By providing stopping means at one side of the tongue, i.e. at the tongue itself, or at the mask, the tongue can be made to collide with the mask when it moves in the direction of said mask.

In a practical embodiment, the tongue comprises a free, folded end portion. By virtue thereof, it is possible, on the one hand, to adjust the resonant frequency of the tongue. On the other hand, the folded portion can readily be used as the stop if it is wider than the opening wherein the non-folded portion extends.

Instead of folding a free end portion, the same object (providing additional mass or forming a stop) can also be achieved by providing the tongue with a welded-on plate.

The stop enables the tongue to move back and forth on one side of the mask. To optimize vibration damping, use is advantageously made of two tongues, the first one of which is arranged such that, during a vibration, it can move back and forth only on one side of the color selection means, the second tongue being arranged such that, during a vibration, it can move back and forth only on the other side of the color selection electrode, An alternative to forming one or more tongues by etching is the use of one or more separate tongues which are welded onto the mask with one end portion. This has the advantage that, as a result of the material choice and the dimensions, the spring characteristics of the tongue can be chosen more freely. A tongue having a wider free end portion than the welded end portion may offer advantages, for example, in that respect. Also in this case, use is effectively made of at least two tongues, each forming a separate part, one tongue being welded with one end portion on one side of the color selection electrode and the other tongue being welded on the opposite side of the color selection electrode.

In the case of sinusoidal movements of the mask, a deflection to one side can be damped by one half of the tongues, while a deflection to the other side can be damped by the other half of the tongues.

The above-described embodiments are based on the principle of energy exchange through collision. Although this seems to be the most effective way, it is alternatively possible, within the scope of the invention, to exchange energy through friction. For this purpose, an embodiment of the display tube in accordance with the invention is characterized in that a first part of the tongue is bent so as to extend outside the plane of the color selection electrode, and a second part is bent back again towards said plane and is capable of moving through an opening in said tongue, its movement being limited by the friction against one or more walls of the opening.

The invention also relates to an advantageous method of manufacturing a color selection electrode for a display tube, characterized in that a metal foil is provided and in that openings allowing passage of electrons are etched in a central portion of the foil and, simultaneously, at least one U-shaped slot is etched in a circumferential part of the foil, the material inside the slot forming the tongue.

By providing, in one etch process, both the openings allowing passage of electrons and slots defining a tongue or tongues, the provision of the vibration damping means in accordance with the invention hardly requires additional costs or additional effort.

These and other aspects of the invention will be apparent from and elucidated with reference to the embodiment(s) described hereinafter.

Figure 1:
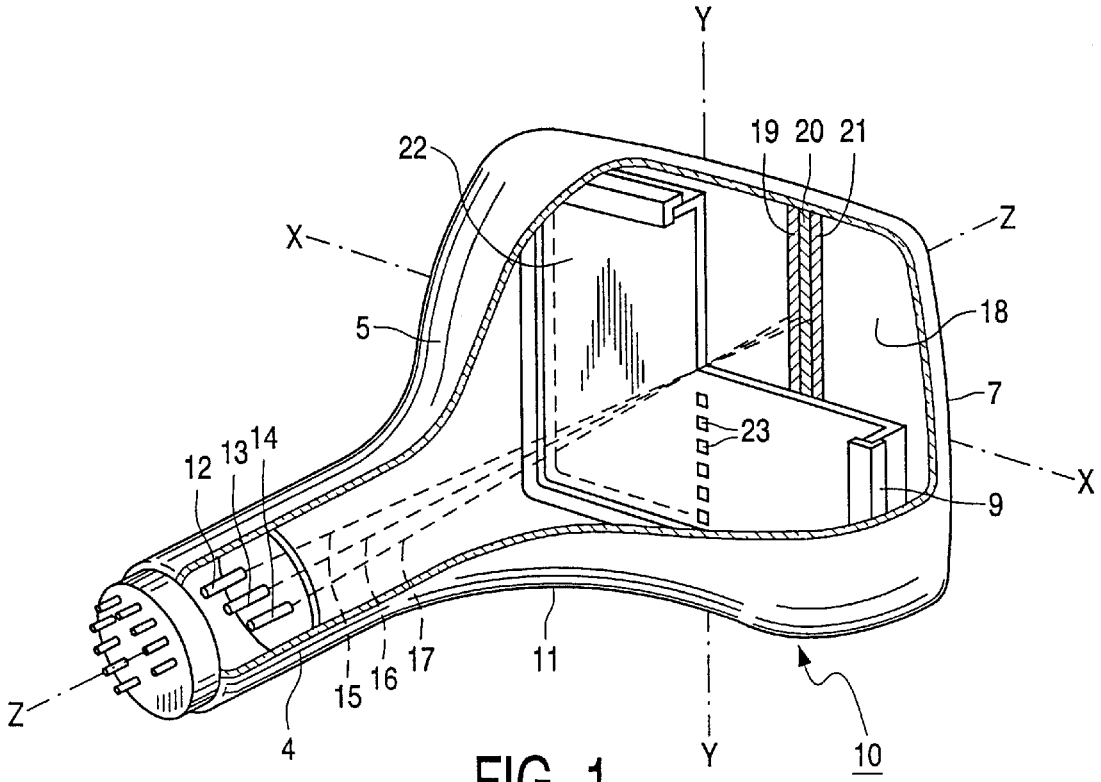
FIG. 1 is a partly cut-away, perspective view of a color display tube comprising a color selection means.

The cathode ray tube 10 shown in FIG. 1 is composed of an evacuated glass envelope 11 having a neck 4, a funnel-shaped portion 5 and a front panel or display window 7 having an inner surface on which a display screen 18 having a pattern of stripes, three of which 19, 20 and 21 are shown, of phosphors luminescing in different colors (for example red, green and blue) is provided. A rectangular frame 9 supports a mask 22 at a small distance from the display screen 18. The mask may be a slotted mask having elongated openings 23 or a so-called wire mask. During operation of the tube, an electron gun system 12, 13, 14 arranged in the neck of the tube sends electron beams 15, 16, 17 through the mask towards the display screen causing phosphors to emit light. A deflection device, not shown, ensures that the electron beams 15, 16, 17 systematically scan the display screen 18.

Figure 2:
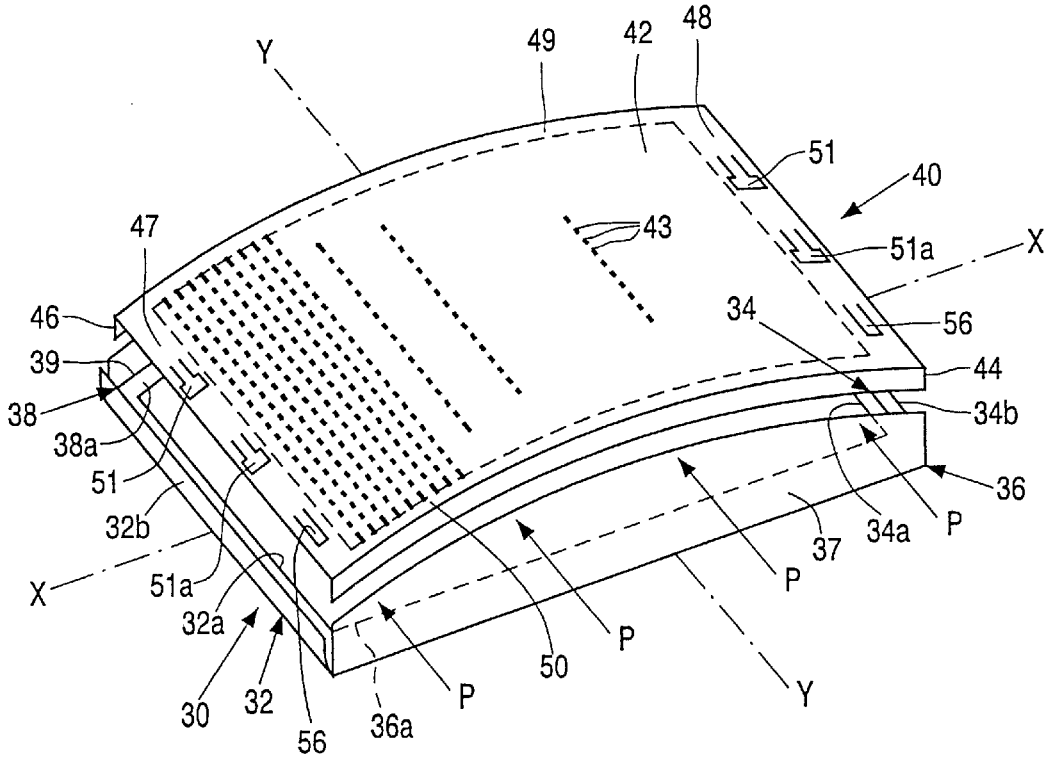
FIG. 2 is a perspective view of a color selection means with a slotted mask having a cylindrical curvature.
Figure 7:
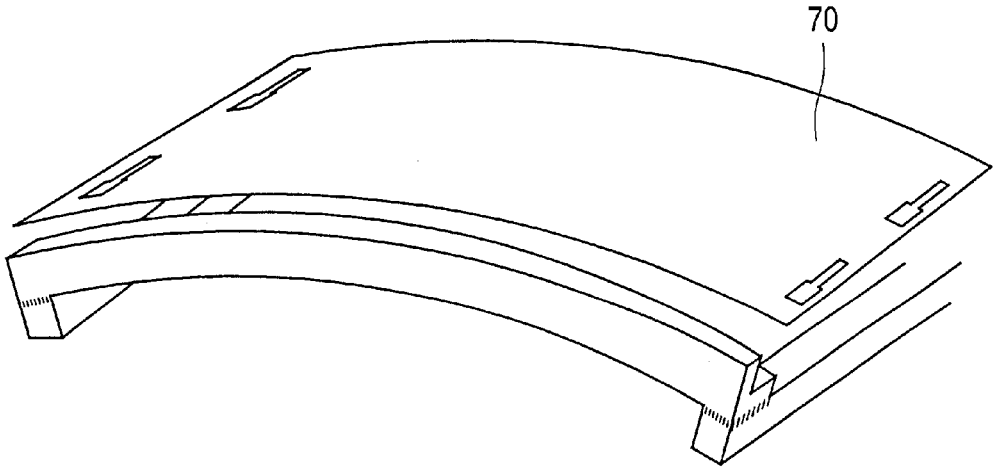
FIG. 7 illustrates a color selection means with mask according to other possible embodiments.

FIG. 2 shows a view of a color selection electrode 40 comprising, in this case, a cylindrically curved mask 42 and a rectangular metal frame 30 onto which the mask 42 is clamped. The metal frame 30 includes side members 32 and 34 and upper and lower members 36 and 38, which upper and lower members have upright edges 37 and 39 for securing them to the folded edges 44, 46 of the mask 42. In alternative constructions, the upright edges of the upper and lower members include edges extending in the Y-direction (the transverse direction) and the mask 70 (extending in one plane) is secured thereto (FIG. 7). There are various methods of securing the mask 42 to the support 30, for example by subjecting the edges 37 and 39 to an inward pressure, as indicated by means of the arrows P, securing the mask, for example, by means of welding, and removing the inward pressure.

In this example, the side members and the upper and lower members (32, 34, 15 36 and 38) each comprise flange members 32*a*, 34*a*, 36*a* and 38*a*, respectively, and upright edges 32*b*, 34*b*, 37 and 39, and hence are L-shaped in section. In the corners of the frame, the flange members adjoin each other such that they form a continuous, rectangular opening allowing electrons to pass to the central part of the mask 42. However, the invention is not limited to such a frame. Instead of L-shaped, the frame members may be, for example, tubular in shape. Furthermore, the mask in this example is cylindrically curved. However, the invention also relates to other types of tension masks, in particular flat masks. It is important that the central part of the mask 42 having apertures is surrounded by a circumferential part (47, 48, 49, 50). Here, vibration damping means in accordance with the invention are provided which exchange vibration energy through collision or friction (directly) with the circumferential part, as diagrammatically indicated by means of reference numerals 51, 51A, 56. Embodiments of such vibration damping means are described in greater detail with reference to FIGS. 3, 4, 5 and 6. It is very effective to provide said vibration damping means on the circumferential parts 47 and 48, which extend parallel to the transverse axis Y of the mask, however, they may alternatively be provided on the circumferential parts 49 and 50.

Figure 3:
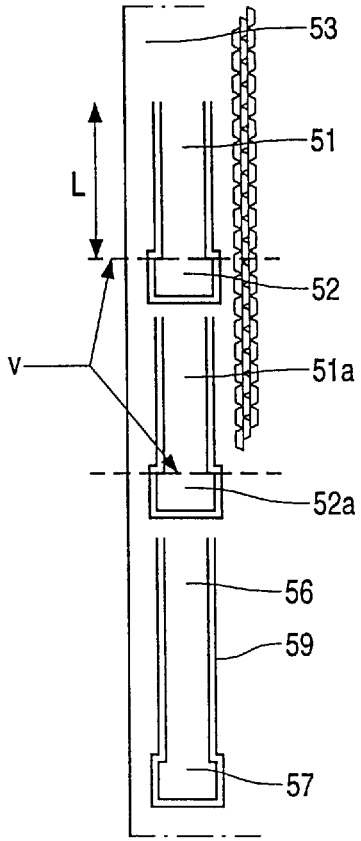
FIG. 3 is a front view of a part of a color selection means in accordance with the invention.
Figure 4:
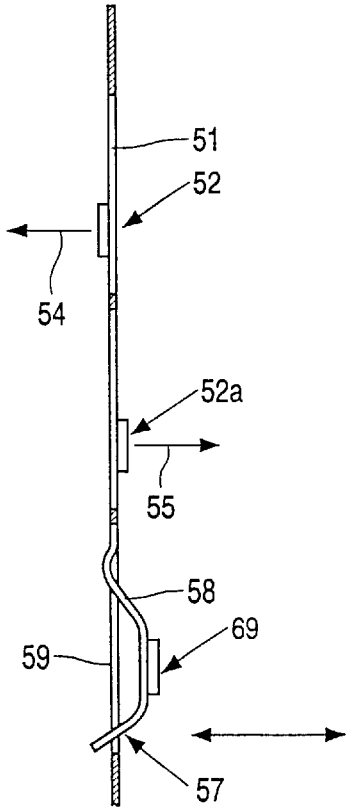
FIG. 4 is a transverse view of a part of a color selection means in accordance with the invention.

FIG. 3 shows a front view of a portion 53 of the circumferential part 47 of the shadow mask (tension mask) 42 (FIG. 2). In said portion, one or more tongues are formed, of which 51, 51A and 56 are visible, by means of etching a U-shaped slot, which tongue or tongues are capable of vibrating when the mask vibrates. The tongue 51 has a free end portion 52 which is wider than the rest of the tongue. By folding this portion 52 along a folding line V, a stop is formed enabling the tongue 51 to vibrate only on one side of the mask, as indicated by means of arrow 54 in the cross-sectional view of the shadow mask of FIG. 4. The free end portion 52A of the tongue 51A is similarly folded along a folding line V, in such a way that tongue 51A can only vibrate on the opposite side, compared to tongue 51, of the mask, as indicated by means of arrow 55. In this manner, vibration damping of the mask in two directions can be achieved (in that the stops of the tongues collide with the mask, thereby exchanging vibration energy). An embodiment wherein vibration energy is exchanged by means of friction is explained with reference to tongue 56. Tongue 56 has a wider end portion 57, but unlike tongue 51 and 51A, the portion 58 adjoining the fixed portion of the tongue 57 is bent so as to extend outside the plane of the mask, and the portion having the wider end portion 57 is bent back, such that the wider end portion projects through the opening 59 resulting from the process wherein the tongue 56 is formed by etching. All these parts are arranged and dimensioned such that the wider end portion 57, upon vibration of the tongue 56, is capable of rubbing the walls of the part of the opening from which it has not been etched, and hence exchanges vibration energy with the mask.

Figure 5:
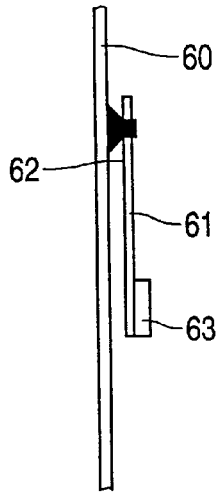
FIG. 5 is a diagrammatic, cross-sectional view of a part of a mask onto which a tongue is welded.

FIG. 5 is a transverse view of an alternative embodiment of a mask 60 on which a tongue 61 is welded with an end portion 62. The tongue 61 may be provided with a (metal) plate 63 to adjust its vibration frequency. This vibration frequency can also be adjusted by suitably choosing the length L. In this respect reference is also made to FIG. 3. Such an adjusting plate 69 may also be provided on a tongue etched from the mask (see FIG. 4).

Figure 6:
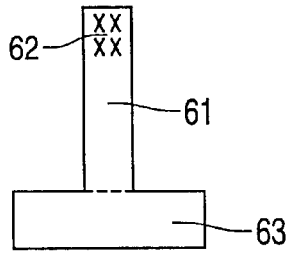
FIG. 6 is a plan view of a part of a mask onto which a tongue is welded.

As shown in FIG. 6, which is a plan view of the tongue 61, it is possible for the plate 63 to be wider than the tongue itself and to project on two sides, however, this is not necessary. Alternatively, use can be made of, for example, a T-shaped tongue.

It may also be advantageous to secure a wider plate to a tongue etched from the mask. This wider plate may serve as the stop, so that, unlike the tongues 51 and 51A, folding of the tongue is not necessary. In addition, after folding an opening remains in the mask through which undesirable electrons may fall. This problem does not arise when use is made of a stop which is welded onto the tongue. Instead of welding the stop onto the tongue, the stop may be provided, if necessary, on the mask, across the hole formed by etching.

The Figures show that the tongues forming vibration damping means in accordance with the invention substantially extend in, or parallel to, the plane of the mask, so that the place which they take up is minimized.

In an experiment, vibration damping was achieved using tongues having a length of 1 to 2 cm, a width of 4 mm and a thickness of 1 mm. The spring characteristic can be slackened by welding an additional plate of 3 mm×4 mm having a thickness of 0.5 mm, or by providing the tongue with holes. The frequencies of the vibrations taking place were at several hundred Hertz.

Briefly summarized, the invention thus relates to a display tube comprising a color selection electrode and means for supporting the color selection electrode in tension, which color selection electrode includes a circumferential part provided with vibration damping means. The vibration damping means include a resonator in the form of at least one metal tongue which is capable of vibrating when the color selection electrode vibrates, and which is arranged, preferably, in, or parallel to, the plane of the color selection electrode, while means are present for exchanging vibration energy through collision or friction between the tongue and the circumferential part of the color selection electrode.

What is claimed is:

1. A display tube comprising a display window having two short sides and two long sides, and a color selection electrode having a longitudinal axis and a transverse axis and supporting means for supporting the color selection electrode in tension, which color selection electrode comprises a central portion having apertures allowing passage of electrons, and a circumferential part, which circumferential part is provided with vibration damping means, wherein the vibration damping means include a resonator in the form of at least one metal tongue, which is capable of vibrating when the color selection electrode vibrates, and is arranged in such a way, and/or co-operates with such means, that it is capable of exchanging vibration energy by means of collision and/or friction with the circumferential part of the color selection electrode, and wherein the at least one metal tongue extends substantially parallel to a plane of the color selection electrode.

2. A display tube as claimed in claim 1, wherein the color selection electrode comprises parts which are mechanically coupled to each other and extend parallel to the transverse axis.

3. A display tube as claimed in claim 1, wherein the at least one tongue is provided near a short side of the window.

4. A display tube as claimed in claim 1, wherein the at least one tongue is formed from the material of the circumferential part and has four sides, three of which are separated from the material of the circumferential part by means of slots.

5. A display tube as claimed in claim 1, further including a stopping means that collides with the at least one metal tongue.

6. A display tube as claimed in claim 5, wherein the at least one metal tongue has a free end portion which is folded.

7. A display tube as claimed in claim 6, wherein the folded end portion is wider than the opening wherein the unfolded part of the at least one metal tongue extends.

8. A display tube as claimed in claim 1, wherein at least two tongues are provided, the first one being arranged such that, during a vibration, it can move back and forth only on one side of the color selection means, and the second one being arranged such that, during a vibration, it can move back and forth only on the other side of the color selection electrode.

9. A display tube as claimed in claim 1, wherein a metal plate is welded onto the at least one metal tongue.

10. A display tube as claimed in claim 9, wherein the welded plate is wider than the at least one metal tongue in order to form a stop.

11. A display tube as claimed in claim 1, wherein the at least one tongue is an independent part welded to the color selection electrode with one end portion.

12. A display tube as claimed in claim 1, wherein a first part of the at least one metal tongue is bent so as to extend outside the plane of the color selection electrode, and a second part of the at least one metal tongue is bent back to said plane and is capable of moving through an opening in said at least one metal tongue, its movements being limited by friction against one or more walls of the opening.

13. A display tube as claimed in claim 11, wherein two tongues are provided which each constitute an independent part, one tongue being welded, with an end portion, to one side of the color selection electrode, and the other tongue being welded, with an end portion, to the opposite side of the color selection electrode.

14. A display tube as claimed in claim 1, wherein the at least one metal tongue is provided with additional mass in order to slacken its spring characteristic.

15. A display tube as claimed in claim 1, wherein the color selection electrode is provided with holes.

16. A display tube as claimed in claim 1, wherein a number of tongues are provided near at least one side of the color selection electrode.

17. A method of manufacturing the display tube of claim 1.

* * * * *